US010180002B2

(12) United States Patent
Freiborg

(10) Patent No.: US 10,180,002 B2
(45) Date of Patent: Jan. 15, 2019

(54) LAMINATED ROOF SHINGLE

(71) Applicant: Mark Freiborg, Long Beach, CA (US)

(72) Inventor: Mark Freiborg, Long Beach, CA (US)

( * ) Notice: Subject to any disclaimer, the term of this patent is extended or adjusted under 35 U.S.C. 154(b) by 0 days.

(21) Appl. No.: 15/627,302

(22) Filed: Jun. 19, 2017

(65) Prior Publication Data

US 2018/0363300 A1 Dec. 20, 2018

(51) Int. Cl.

| | |
|---|---|
| ***E04D 1/26*** | (2006.01) |
| ***B32B 38/00*** | (2006.01) |
| ***B32B 37/14*** | (2006.01) |
| ***E04D 1/00*** | (2006.01) |

(52) U.S. Cl.

CPC ..... *E04D 1/26* (2013.01); *B32B 37/14* (2013.01); *B32B 38/0004* (2013.01); *B32B 2419/06* (2013.01); *E04D 2001/005* (2013.01)

(58) Field of Classification Search

CPC ..... E04D 1/26; E04D 1/28; E04D 2001/005; B32B 11/12; B32B 38/0004; B32B 37/24; B32B 37/14; B32B 9/002; B32B 5/16; B32B 2419/06; B32B 2307/404; B26D 3/10

See application file for complete search history.

(56) References Cited

U.S. PATENT DOCUMENTS

| | | | | |
|---|---|---|---|---|
| 3,613,328 A | | 10/1971 | Morgan, Jr. et al. | |
| 3,624,975 A | * | 12/1971 | Morgan et al. | E04D 1/26 52/105 |
| 4,233,100 A | | 11/1980 | Cunningham | |
| 4,274,243 A | | 6/1981 | Corbin | |
| 4,333,279 A | * | 6/1982 | Corbin | E04D 1/26 52/105 |
| 4,527,374 A | * | 7/1985 | Corbin | E04D 1/26 52/557 |
| 4,717,614 A | | 1/1988 | Bondoc | |
| D344,144 S | | 2/1994 | Weaver | |
| 5,369,929 A | | 12/1994 | Weaver | |
| 5,426,902 A | | 6/1995 | Stahl | |
| 5,611,186 A | | 3/1997 | Weaver | |
| 5,666,776 A | * | 9/1997 | Weaver | E04D 1/26 52/314 |
| 6,010,589 A | | 1/2000 | Stahl | |
| 6,014,847 A | | 1/2000 | Phillips | |
| 6,174,403 B1 | * | 1/2001 | Steiner, Jr. | B32B 37/20 156/260 |

(Continued)

OTHER PUBLICATIONS

U.S. Appl. No. 15/925,238, Non Final Action dated May 24, 2018.

*Primary Examiner* — Rodney Mintz

(57) ABSTRACT

A laminated composition shingle includes a first sheet having a first mineral granule surface and a first rectangular shape without tab cut-outs laminated with a second sheet having a second mineral granule surface. The second sheet has tab cut-outs along only one of the longer edges of the second sheet. An exposed portion of the laminated composition shingle that remains uncovered when the laminated composition shingle forms a roof covering has a width that is between 40% and 45% of an overall width of the laminated composition shingle. A width of the tab cut-outs is between 90% and 97% of the width of the exposed portion of the laminated composition shingle. All the tab cut-outs may have the same width. There may be visible marking on the shingle to indicate placement of the next course of shingles.

12 Claims, 4 Drawing Sheets

(56) References Cited

U.S. PATENT DOCUMENTS 6,190,754 B1 2/2001 Bondoc
6,220,329 B1 4/2001 King
6,289,648 B1 9/2001 Freshwater
6,305,138 B1 10/2001 Stahl
6,361,851 B1 * 3/2002 Sieling ..... B32B 3/02 428/141
6,457,290 B1 10/2002 Elliott
D466,629 S 12/2002 Phillips
6,708,456 B2 3/2004 Kiik
6,933,037 B2 8/2005 McCumber
7,240,462 B2 7/2007 Elliott et al.
8,430,983 B2 4/2013 Vermilion
8,438,812 B2 * 5/2013 King ..... E04D 1/26 52/314
8,623,164 B2 1/2014 Belt
8,776,471 B2 * 7/2014 Jenkins ..... E04D 1/26 428/141
8,789,332 B1 * 7/2014 Halliley ..... B65D 83/0894 206/323
8,793,955 B2 8/2014 Ray
9,140,012 B1 9/2015 Leitch
D750,810 S 3/2016 Buzza
9,464,439 B2 10/2016 Buzza
9,739,062 B2 8/2017 Leitch
2003/0040241 A1 2/2003 Kiik
2003/0163964 A1 9/2003 Elliott
2004/0103611 A1 * 6/2004 King ..... E04D 1/26 52/554
2004/0107664 A1 6/2004 Rodrigues
2004/0123537 A1 7/2004 Elliott
2004/0123543 A1 7/2004 Elliott
2005/0193673 A1 9/2005 Rodrigues
2006/0059834 A1 * 3/2006 Elliott ..... E04D 1/26 52/557
2006/0179767 A1 * 8/2006 Miller ..... B32B 3/08 52/555
2007/0042158 A1 2/2007 Belt
2007/0068108 A1 3/2007 Kiik
2008/0005995 A1 1/2008 Elliott
2011/0197534 A1 8/2011 Belt
2011/0209428 A1 * 9/2011 Elliott ..... E04D 1/26 52/526
2011/0283646 A1 11/2011 Vermilion
2012/0258282 A1 10/2012 Hammond
2012/0260597 A1 10/2012 Jenkins
2013/0025224 A1 1/2013 Vermilion
2013/0025226 A1 1/2013 Jenkins
2013/0298490 A1 * 11/2013 Jenkins ..... E04D 1/26 52/557
2014/0245690 A1 9/2014 Stahl
2014/0260047 A1 * 9/2014 Jenkins ..... E04D 1/26 52/518
2015/0315789 A1 11/2015 Buzza
2016/0177569 A1 6/2016 Leitch
2016/0340903 A1 * 11/2016 Folkersen ..... E04D 1/26
2017/0175393 A1 6/2017 Leitch
2017/0321423 A1 * 11/2017 Aschenbeck ..... E04D 1/36

* cited by examiner

LAMINATED ROOF SHINGLE

BACKGROUND

Field

Embodiments of the invention relate to the field of roofing shingles; and more specifically, to laminated asphalt roofing shingles.

Background

Asphalt shingles are a commonly used roofing material. Such shingles may be manufactured as a laminated shingle to provide improved durability and appearance. A strip shingle in laminated form may include a base layer of composite roofing sheet material that is the full length dimension of the strip shingle and with no tab cut-outs. Laminated to this base layer is an overlay layer of similar composite roofing sheet material of the same length as the base. The overlay layer is adhesively laminated to the base layer, preferably with roofing asphalt.

The overlay layer may be of a different width than the base layer and have multiple, widely spaced cut-out tabs of rectangular or approximately rectangular shape, of the same or differing widths and the same or differing lengths. The pattern of tabs may be regular or randomized to avoid a discernable pattern when many shingles are laid as a roof covering. The pattern of tabs is sometimes referred to as a "dragon tooth" pattern. The surface areas of the base layer exposed in the spaces between the tabs of the overlay layer become tab-simulating areas of the laminated shingle when it is laid on the roof.

The composite roofing sheet material has an exposed surface that is coated with a mineral surface, e.g. crushed rock. The mineral surface provides a durable roofing surface that can be provided in a variety of colors, including variegated colors. The base layer and the overlay layer are generally made from sheet materials of different colors. This provides a contrast between the tabs of the overlay layer and the tab-simulating areas of the base layer that are exposed through the cut-outs of the overlay layer.

Even though laminated asphalt shingles offer significant cost, service life, and flammability advantages over wood shingles, wood shingles are still often preferred due to the pleasing aesthetic appearance of a wood shingled roof. An important aesthetic advantage of wood shingles is their greater thickness as compared to composite shingles. The thickness of wood shingles results in a more pleasing, layered look for the finished roof.

It would be desirable to provide a laminated asphalt shingle that allows colored granules to be applied to the composite roofing sheet material in a way that improves the aesthetic appearance of the laminated asphalt shingle.

BRIEF DESCRIPTION OF THE DRAWINGS

The invention may best be understood by referring to the following description and accompanying drawings that are used to illustrate embodiments of the invention by way of example and not limitation. In the drawings, in which like reference numerals indicate similar elements.

DETAILED DESCRIPTION

Figure 1:
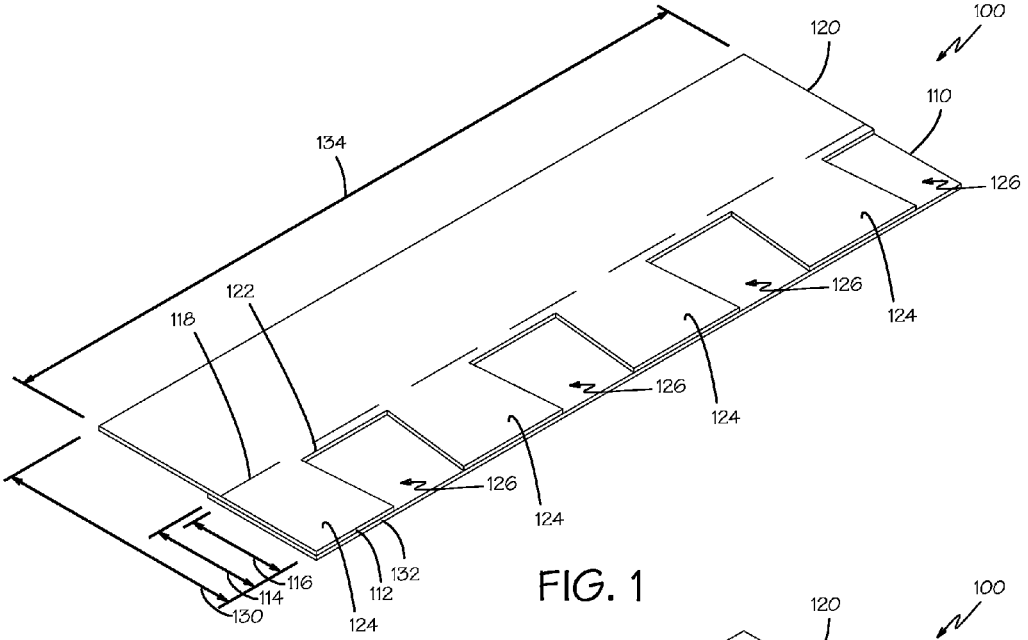
FIG. 1 is a pictorial view of an illustrative laminated composition shingle.

In the following description, numerous specific details are set forth. However, it is understood that embodiments of the invention may be practiced without these specific details. In other instances, well-known circuits, structures and techniques have not been shown in detail in order not to obscure the understanding of this description.

In the following description, reference is made to the accompanying drawings, which illustrate several embodiments of the present invention. It is understood that other embodiments may be utilized, and mechanical compositional, structural, and operational changes may be made without departing from the spirit and scope of the present disclosure. The following detailed description is not to be taken in a limiting sense, and the scope of the embodiments of the present invention is defined only by the claims of the issued patent.

Dimensional information in the following description should be understood as nominal dimensions that are intended to encompass variations in dimensions that normally occur in the commercial production of laminated asphalt composition roofing shingles. Terms such as "approximately," "about," and "substantially" may be used to qualify dimensional information in the following description but such qualifications are intended merely to reinforce that the dimensions are nominal dimensions and not to differentiate qualified dimensions from unqualified dimensions. It will be recognized that roofing shingles are not precision parts and that substantial variations in dimensions can occur between nominally identical shingles without affecting their function or usability.

The terminology used herein is for the purpose of describing particular embodiments only and is not intended to be limiting of the invention. Spatially relative terms, such as "beneath", "below", "lower", "above", "upper", and the like may be used herein for ease of description to describe one element's or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (e.g., rotated 90 degrees or at other orientations) and the spatially relative descriptors used herein interpreted accordingly.

As used herein, the singular forms "a", "an", and "the" are intended to include the plural forms as well, unless the context indicates otherwise. It will be further understood that the terms "comprises" and/or "comprising" specify the presence of stated features, steps, operations, elements, and/or components, but do not preclude the presence or addition of one or more other features, steps, operations, elements, components, and/or groups thereof.

The terms "or" and "and/or" as used herein are to be interpreted as inclusive or meaning any one or any combination. Therefore, "A, B or C" or "A, B and/or C" mean "any of the following: A; B; C; A and B; A and C; B and C; A, B and C." An exception to this definition will occur only when a combination of elements, functions, steps or acts are in some way inherently mutually exclusive.

Figure 2:
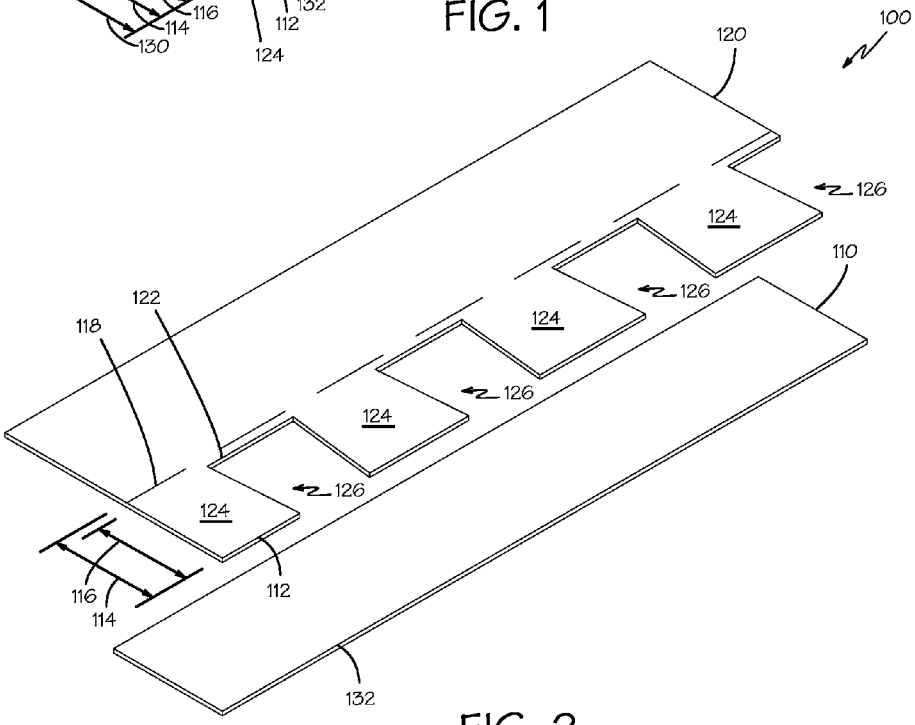
FIG. 2 is an exploded view of the laminated composition shingle shown in FIG. 1.

FIG. 1 is a pictorial view of an exemplary laminated asphalt composition roofing shingle 100 that embodies the invention. FIG. 2 is an exploded view of the laminated asphalt composition roofing shingle 100 of FIG. 1 that shows the structure of the shingle.

The laminated composition shingle 100 shown in FIG. 1 includes a first sheet 110 having a first mineral granule surface and a first rectangular shape without tab cut-outs. A second sheet 120 having a second mineral granule surface and a plain surface opposite the second mineral granule surface is laminated to the first sheet 110 to form the shingle 100. The plain surface of the second sheet 120 is laminated to the first mineral granule surface of the first sheet 110. The second sheet 120 has a number of tabs 124 defined by tab cut-outs 126.

The longer edge 112 of the second sheet having the tab cut-outs is adjacent to one of the longer edges 132 of the first sheet. In the shingle 100 shown in FIG. 1, the longer edge 112 of the second sheet 120 is aligned with the longer edge 132 of the first sheet 110. The adjacent longer edges are the edges that will be fully exposed when the shingle is installed as part of a complete shingle roof.

In other shingles, the longer edge of the second sheet may be slightly offset from the longer edge of the first sheet for the purpose of creating certain decorative appearances. In still other shingles, the longer edge of either or both of the sheets may not be a straight line.

The dimensions of most asphalt composition roofing shingles are standardized either to a width 130 of 12" by a length 134 of 36" or to a width of 0.337 m by a length of 1 m (13¼"×39⅜"). If the longer edge of the shingle is not a straight line, the standardized dimensions will generally be for the largest rectangle that is fully covered by the shingle.

Laminated composition roofing shingles may have a portion that is a double thickness and a remaining portion that is a single thickness. The construction of most laminated composition roofing shingles is standardized such that the single thickness portion is slightly wider than the double thickness portion. Pairs of shingles can thus be stacked with a double thickness portion against a single thickness portion to produce a package of uniform thickness. Laminated composition roofing shingles that embody the invention can be made according to these standards. While laminated composition roofing shingles made from two sheets of material are shown and described, it will be appreciated that additional sheets may be used to form a laminated shingle that embodies the invention.

Figure 3:
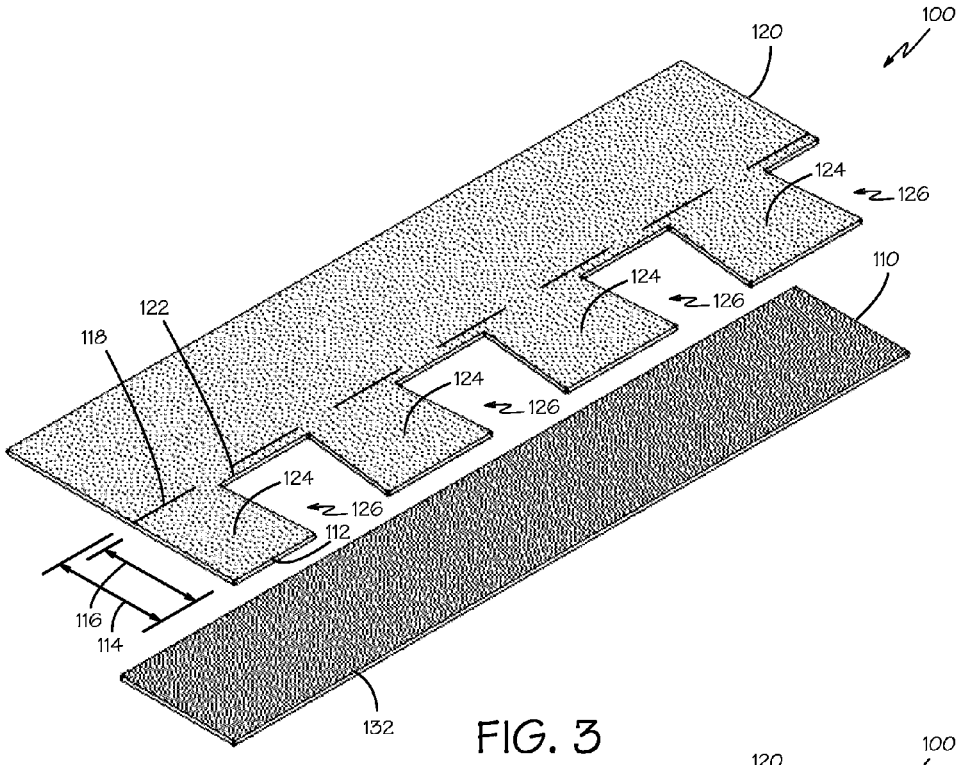
FIG. 3 is an exploded view of the laminated composition shingle shown in FIG. 1 with stippling to suggest a colored mineral granule surface.
Figure 4:
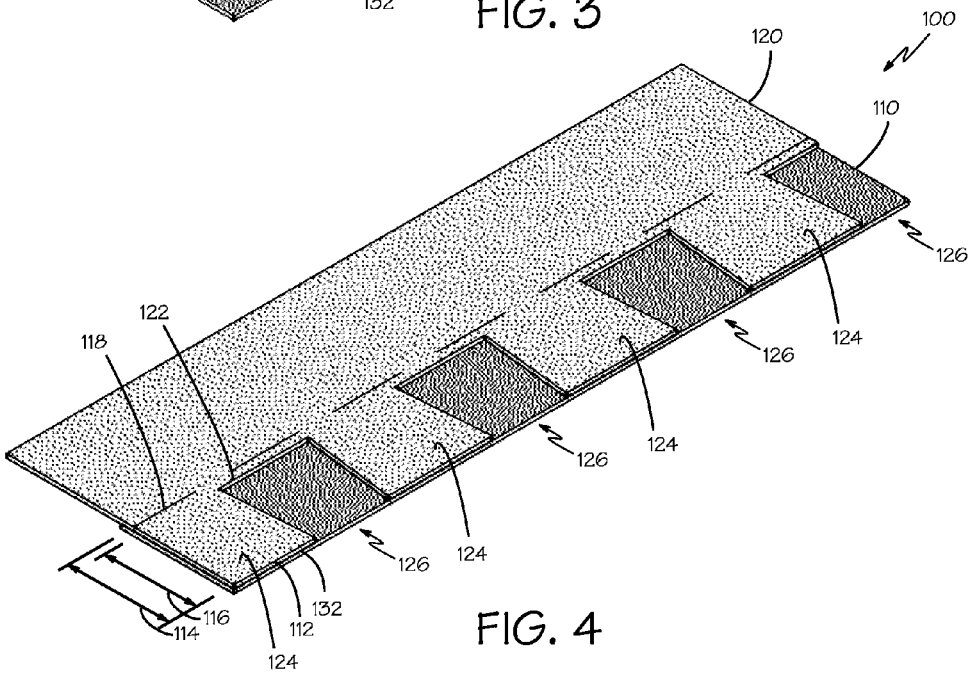
FIG. 4 is a pictorial view of the laminated composition shingle shown in FIG. 1 with stippling to suggest a colored mineral granule surface.

FIGS. 3 and 4 are an exploded view and a pictorial view respectively of the laminated asphalt composition roofing shingle 100 shown in FIG. 1. Stippling has been added to suggest colored mineral granule surfaces, such as crushed rock, that may provide a surface on the sheets 110, 120 that form the shingle 100. As suggested by the stippling, the first sheet 110 without tab cut-outs often has a darker mineral granule surface than the second sheet 120 having tabs 124. The mineral granule surfaces may be of variegated colors for the purpose of creating certain decorative appearances. As can be seen in FIG. 4, the contrasting colors of the mineral granule surfaces can reinforce the appearance of the tabs 124 and increase the appearance of thickness variations of the shingle 100.

Figure 5:
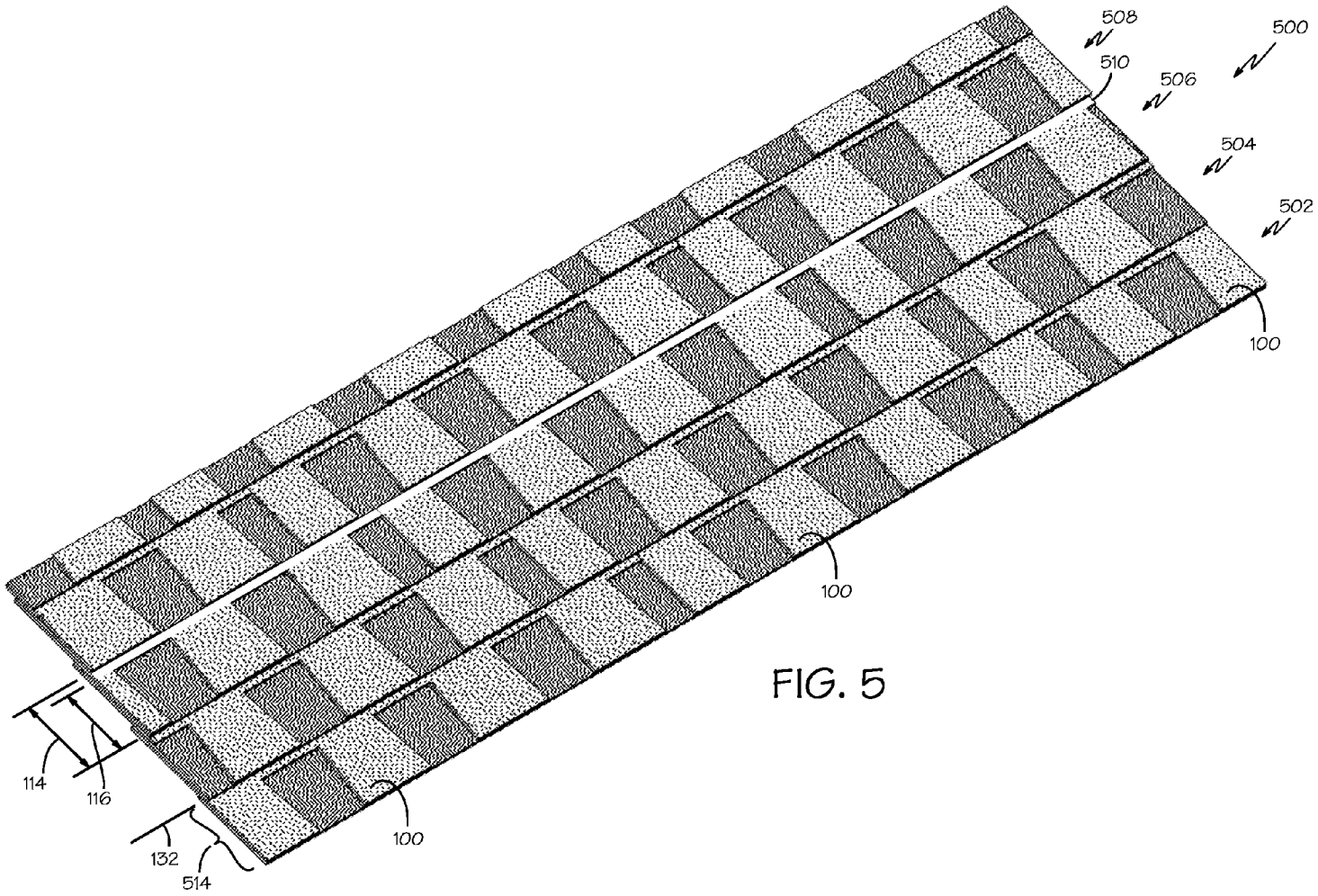
FIG. 5 is a pictorial view of a portion of a roof to which laminated composition shingles of the type shown in FIGS. 1 and 3 have been applied.

FIG. 5 is a pictorial view of a portion of a roof 500 covered with laminated asphalt composition roofing shingles 100 of the type shown in FIGS. 1 and 4. Laminated composition shingles 100 are applied to a roof by laying rows or courses 502, 504, 506, 508 of shingles laid end to end with the lower edge 132 of the shingles parallel to a lower edge or eave of the roof. Successive courses of shingles are laid with a portion 514 of the preceding course 502 of shingles left exposed below the lower edge 132 of the succeeding course 504. Generally, somewhat less than half of each shingle is left exposed to provide a water-tight roof by providing a headlap, as explained below.

A portion of the shingles 100 in one course 502 immediately above the exposed portion 514 will be covered both by the succeeding course 504 and by the next succeeding course 506. Thus, there will be three shingles layered together immediately above the exposed portion of a shingle. This portion of the shingle is called the headlap. It is desirable to provide a 2" (51 mm) headlap. The width of the headlap is the width 130 of the shingle less twice the exposure 114. Laying a 12"×36" laminated composition shingles with 5" exposure of the tabs provides a 2" headlap, 12"-(2×5"). Laying a 0.337 m×1 m (13¼"×39⅜") laminated composition shingle with 0.143 m (5⅝") exposure of the tabs also provides a 51 mm (2") headlap, 0.337 m-(2×0.143 m).

The exposed portion of the laminated composition shingle generally has a width that is between 40% and 45% of the overall width of the laminated composition shingle. Thus the exposed portion of 12"×36" laminated composition shingles is generally between 4.8" (0.40×12") and 5.4" (0.45×12"). The exposed portion of 0.337 m×1 m (13¼"×39⅜") laminated composition shingles is generally between 0.135 m (5.30") and 0.152 m (5.96").

The width 116 of the cut-out tabs 126 in the overlay layer 120 of a laminated composition shingle 100 that embodies the invention is less than the exposure 114 of the shingle. This differs from conventional laminated asphalt shingles in which the width of the cut-out tabs is the same as the exposure. Reducing the width 116 of the cut-out tabs 126 results in an uninterrupted area 510 on the overlay layer 120 above the cut-out tabs 126. The uninterrupted area 510 of the third course 506 has been highlighted in FIG. 5 by removing the stippling in the uninterrupted area. The uninterrupted area 510 is a continuous rectangular area with a length equal to the length 134 of the shingle 100. The width of the uninterrupted area 510 is the exposure 114 minus the width 116 of the cut-out tabs 126. The uninterrupted area 510 will be immediately adjacent to the lower edge 112 of a succeeding course. The uninterrupted area 510 on the overlay layer 120 provides an area that can be colored in contrast to the tabs 124 of the overlay layer and the tab-simulating areas of the base layer visible through the tab cut-outs 126 immediately below the uninterrupted area.

Pairs of overlay layers 120 are cut as interlocking tab strips from a single sheet of shingle roofing material. The cut-out tabs 126 of a first overlay layer are rotated 180° to become the tabs of a second overlay layer. Therefore the tabs 124 of the overlay layer 120 and the tab-simulating areas 126 of the base layer 110 cannot provide the ability to color a laminated shingle 100 in the same way as the uninterrupted area 510 on the overlay layer. The coloring that falls on a conventional overlay layer immediately adjacent to the lower edge of a succeeding course will also fall on the lower exposed edge of the overlay layer because of use of the cut-out tabs of one overlay layer to become the tabs of another overlay layer with a 180° rotation.

The width 116 of the cut-out tabs 126 in the overlay layer 120 of a laminated composition shingle 100 that embodies may be between 90% and 97% of the width 114 of the exposed portion 514 of the laminated composition shingle. Thus the width 116 of the cut-out tabs 126 in an inventive 12"×36" laminated composition shingle with a typical 5" exposure is between 4.50" (0.90×5") and 4.85" (0.97×5"). This will provide an uninterrupted area 510 on the overlay layer 120 between 0.15" and 0.50" wide. The width 116 of the cut-out tabs 126 in an inventive 0.337 m×1 m (13¼"×39⅜") laminated composition shingle with a typical 0.143 m (5⅝") exposure is between 0.129 m (5.06") and 0.139 m (5.46"). This will provide an uninterrupted area 510 on the overlay layer 120 between 4 mm (0.16") and 14 mm (0.57") wide.

A laminated composition shingle 100 (FIG. 1) that embodies the invention may include visible marking 118 on the second mineral granule surface of the second sheet 120 at the edge of the exposed portion 114 to indicate a line where the lower edge 132 of a succeeding course of shingles should be placed to provide the correct exposure 514 and headlap. The visible marking 118 may be termed a "lay line." A lay line 118 is desirable on a laminated composition shingle 100 that embodies the invention because the upper edge 122 of the tab cut-outs does not provide an indication of where the lower edge 132 of a succeeding course of shingles should be placed as it does on conventional laminated composition shingles.

The visible marking 118 may be a painted or inked line applied to the second mineral granule surface, a color change in the second mineral granule surface, a gap in the second mineral granule surface, notches at the edge of the shingle, a slit in the second sheet, or other markings that will be visible during the installation of the shingles. The visible marking may extend across the entire length of the shingle, be applied at only two separated points on the shingle, or be intermittent along the length of the shingle.

Figure 6:
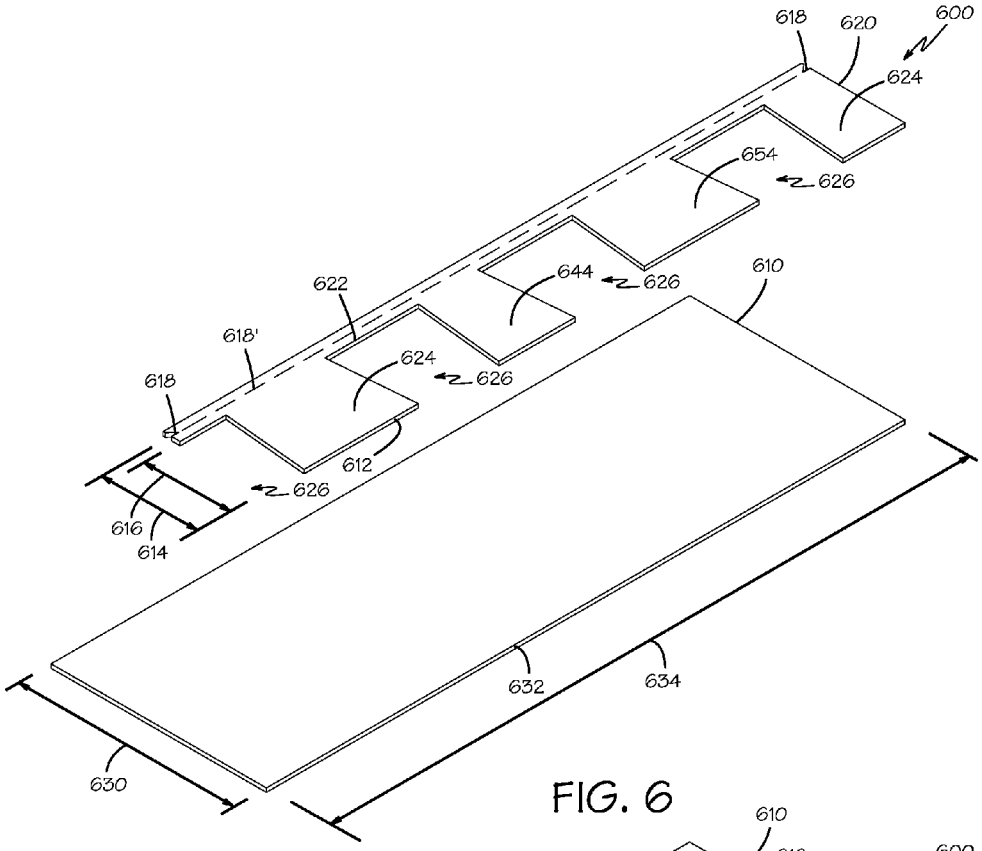
FIG. 6 is an exploded view of another illustrative laminated composition shingle.
Figure 7:
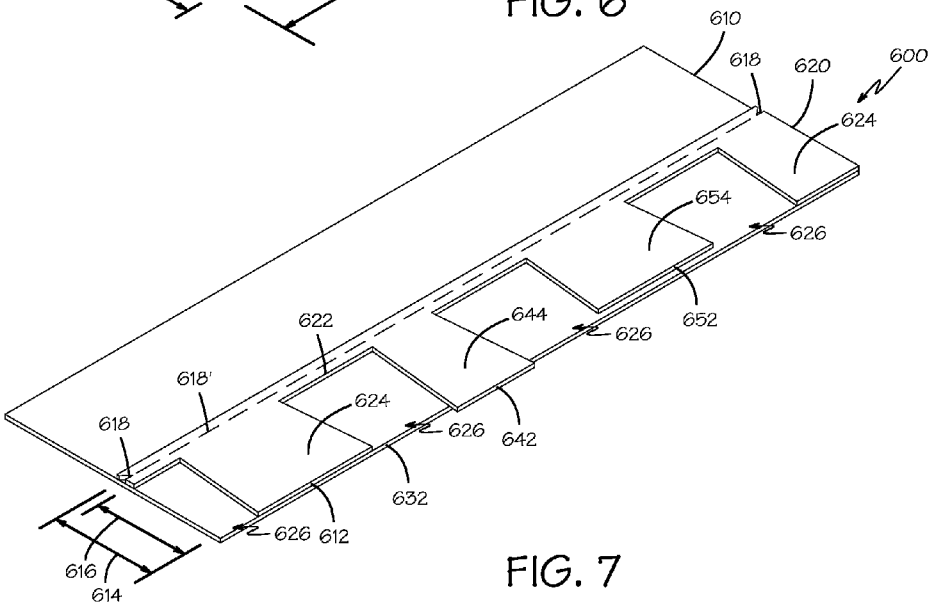
FIG. 7 is a pictorial view of the assembled laminated composition shingle shown in FIG. 6.

FIG. 6 is an exploded view of another exemplary laminated asphalt composition roofing shingle 600 that embodies the invention. FIG. 7 is a pictorial view of the assembled laminated asphalt composition roofing shingle 600 shown in FIG. 6.

The laminated asphalt composition roofing shingle 600 shown in FIGS. 6 and 7 has a first sheet 610 without tab cut-outs that is the full length 634 and full width 630 of the assembled laminated asphalt composition roofing shingle. The second sheet 620, having tab cut-outs 626, is slightly less than one-half the width of the full width 630 of the assembled laminated asphalt composition roofing shingle.

The plain surface of the second sheet 620 is laminated to the first mineral granule surface of the first sheet 610. The longer edge 612 of the second sheet 620 having the tab cut-outs 626 is adjacent to one of the longer edges 632 of the first sheet 610.

As can be seen in FIG. 7, some tabs 644 may be lengthened such that the lower edge 642 of the tab extends beyond the lower edge 632 of the first sheet 610. Other tabs 654 may be shortened such that the lower edge 652 of the tab does not extend to the lower edge 632 of the first sheet 610. Shingles may include only lengthened tabs, only shortened tabs, or both, in various arrangements in addition to the one exemplary arrangement illustrated. As used herein, the width of the tab cut-out 626 is the distance from the longer edge of the shingle providing uninterrupted coverage, the lower edge 632 of the first sheet 610 for the illustrated shingle, to the edge 622 of the tab cut-out adjacent the uninterrupted area of the second sheet 620.

It may desirable that all the edges 622 of the tab cut-outs adjacent the uninterrupted area lie on a straight line. This may require that the lower ends 612, 652 of tabs 624, 654 that are shorter than the longest tab 644 be cut to interlock with another second sheet with a scrap area between the shortened lower ends and the edges adjacent the uninterrupted area.

The laminated asphalt composition roofing shingle 600 shown in FIGS. 6 and 7 has visible marking 618 to indicate where the lower edge 632 of a succeeding course of shingles should be placed to provide the correct exposure and headlap. The visible marking shown in FIGS. 6 and 7 is in the form of notches 618 at the two opposite edges of the second sheet 620. The dashed line 618' shows the lay line that is indicated by the two notches 618, but does not represent a marking applied to the second sheet.

While certain exemplary embodiments have been described and shown in the accompanying drawings, it is to be understood that such embodiments are merely illustrative of and not restrictive on the broad invention, and that this invention is not limited to the specific constructions and arrangements shown and described, since various other modifications may occur to those of ordinary skill in the art. The description is thus to be regarded as illustrative instead of limiting.

What is claimed is:

1. A system comprising:

first and second laminated composition shingles, the first laminated composition shingle comprising:

a first sheet having a first mineral granule surface and a first rectangular shape without tab cut-outs; and a second sheet having a second mineral granule surface, a plain surface opposite the second mineral granule surface, a second rectangular shape, a visible line that indicates where a lower edge of the second laminated composition shingle is placed to provide an exposed portion of the first laminated composition shingle, a width of the exposed portion of the first laminated composition shingle being between 40% and 45% of an overall width of the first laminated composition shingle, tab cut-outs located along only one longer edge of the second sheet having a tab width between 90% and 97% of the width of the exposed portion of the first laminated composition shingle, and the plain surface of the second sheet laminated to the first mineral granule surface of the first sheet with the longer edge of the second sheet having an edge of the tab cut-outs coincident with one longer edge of the first sheet to form the first laminated composition shingle;

wherein the visible line is located on a long edge of the exposed portion of the first laminated composition shingle that is furthest from the longer edge of the second sheet having the tab cut-outs.

2. The system of claim 1, wherein all the tab cut-outs have the same width.

3. The system of claim 1, wherein the visible line is a plurality of intermittent slits in the second sheet along the long edge of the exposed portion.

4. The system of claim 1, wherein the visible line is a notch in the second sheet at each of two ends of the long edge of the exposed portion.

5. The system of claim 1, wherein the first sheet has a length that is the same as a length of the first laminated composition shingle and a width that is less than one-half the overall width of the first laminated composition shingle.

6. The system of claim 5, wherein the second sheet has a length that is the same as the length of the first laminated composition shingle and a width that the same as the overall width of the first laminated composition shingle.

7. A method of making a laminated composition shingle, the method comprising:

cutting a first sheet having a first mineral granule surface and a first rectangular shape without tab cut-outs;

cutting a second sheet having a second mineral granule surface, a plain surface opposite the second mineral granule surface, and a second rectangular shape;

forming a visible line on the second sheet indicating where a lower edge of a second laminated composition shingle is placed thereby providing an exposed portion having a long edge and an exposed width of the laminated composition shingle, the exposed width of the laminated composition shingle being between 40% and 45% of an overall width of the laminated composition shingle;

cutting tab cut-outs along only one longer edge of the second sheet, the tab cut-outs being located along only the one longer edge of the second sheet and having a tab width between 90% and 97% of the exposed width of the laminated composition shingle; and laminating the plain surface of the second sheet to the first mineral granule surface of the first sheet with the longer edge of the second sheet having the tab cut-outs coincident with one longer edge of the first sheet to form the laminated composition shingle.

8. The method of making a laminated composition shingle of claim 7, wherein all the tab cut-outs have the same width.

9. The method of making a laminated composition shingle of claim 7, wherein forming the visible line comprises cutting a plurality of intermittent slits in the second sheet along the long edge of the exposed portion.

10. The method of making a laminated composition shingle of claim 7, wherein forming the visible line comprises cutting a notch in the second sheet at each of two ends of the long edge of the exposed portion.

11. The method of making a laminated composition shingle of claim 7, wherein the first sheet has a length that is the same as a length of the laminated composition shingle and a width that is less than one-half the overall width of the laminated composition shingle.

12. The method of making a laminated composition shingle of claim 11, wherein the second sheet has a length that is the same as the length of the laminated composition shingle and a width that the same as the overall width of the laminated composition shingle.

* * * * *